US008624097B1

(12) United States Patent
Liao

(10) Patent No.: US 8,624,097 B1
(45) Date of Patent: Jan. 7, 2014

(54) CAJON HITTING ASSEMBLY

(71) Applicant: Tsun-Chi Liao, Taichung (TW)

(72) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 13/656,209

(22) Filed: Oct. 19, 2012

(51) Int. Cl.
*G10D 13/02* (2006.01)

(52) U.S. Cl.
USPC ..... 84/422.1

(58) Field of Classification Search
USPC ..... 84/402–410, 422.1, 422.2, 422.3
See application file for complete search history.

(56) References Cited

U.S. PATENT DOCUMENTS 4,048,896 A * 9/1977 Calato et al. ..... 84/422.1
6,541,686 B2 * 4/2003 O'Donnell ..... 84/422.1

* cited by examiner

*Primary Examiner* — Kimberly Lockett
(74) *Attorney, Agent, or Firm* — Muncy, Geissler, Olds & Lowe, PLLC

(57) ABSTRACT

A cajon hitting assembly comprises a foot pedal, a first upright post, a first strut, a wire tube, a second upright post, a second strut and a hitter. The wire tube is threaded by a drawing wire with a start end and a distal end. The first and second upright posts have respectively a first axle and a second axle. The foot pedal drives the first axle to turn. The first strut has two ends fastened respectively to the first axle and start end of the drawing wire. The second strut has two ends fastened respectively to the second axle and distal end of the drawing wire. The hitter is fastened to the second axle. When the foot pedal is treaded, the hitter is driven to hit the cajon. Through lever function provided by the first and second struts, moving displacement of the drawing wire increases.

10 Claims, 7 Drawing Sheets

CAJON HITTING ASSEMBLY

FIELD OF THE INVENTION

The present invention relates to a drum hitting assembly and particularly to a cajon hitting assembly.

BACKGROUND OF THE INVENTION

A cajon looks like a stool which can be sat by people and hit at various positions to generate different sounds, thus is suitable for impromptu performance. The cajon is an empty wooden chest with a round hole formed on the back side as a sound outlet. At the front of the wooden chest, there is a snare installed therein to generate timbre like a snare drum.

Please refer to FIG. 1, in order to facilitate hitting convenience and enhance versatility, the cajon hitting assembly can serve as an ancillary hitting device. A conventional cajon hitting assembly comprises a foot pedal 1, a first upright post 2, a wire tube 3, a second upright post 4, a hitter 5 and a holding rack 6. The holding rack 6 holds a cajon 7. The second upright post 4 has a turnable axle 8 located thereon. The hitter 5 is fastened to the axle 8 to face the cajon 7. The wire tube 3 is threaded by a drawing wire (not shown in the drawing) that has one end fastened to the hitter 5 and other end fastened to the foot pedal 1. The foot pedal 1 is located on the first upright post 2. By treading the foot pedal 1, the drawing wire can be drawn to drive the axle 8 to turn, thereby the hitter 5 is driven to hit the cajon 7.

The cajon hitting assembly can enhance the versatility of hitting the cajon 7 to further enhance appeal of performances. With the drawing wire threading through the wire tube 3, the position of the foot pedal 1 can be adjusted according to user's usual practices and use requirements. However, the displacement generated by the downward tread on the foot pedal 1 directly draws the drawing wire to move that in turn drives the hitter 5 to turn. Thus, the moving displacement of the drawing wire is not enough, and the torsional force being generated also is inadequate. Moreover, a static friction force generally takes place between the drawing wire and wire tube 3. Hence when the torsional force is inadequate, jammed feeling is easily generated during tread on the foot pedal. Thus it cannot fully meet use requirements of the cajon 7 during performance.

SUMMARY OF THE INVENTION

The primary object of the present invention is to provide a cajon hitting assembly capable of treading smoothly to meet use requirements during performance.

To achieve the foregoing object, the cajon hitting assembly according to the invention comprises a first upright post, a first strut, a second upright post, a second strut, a foot pedal, a wire tube, a hitter and a holding rack. The first upright post has a turnable first axle located thereon. The first strut has one end fastened to the first axle. The second upright post has a turnable second axle located thereon. The second strut has one end fastened to the second axle. The foot pedal drives the first axle to turn.

The wire tube is threaded by a drawing wire which has a start end and a distal end. The wire tube has two ends respectively fastened to the first upright post and second upright post. The start end of the drawing wire is fastened to the first strut and spaced from the first axle at a first distance. The distal end of the drawing wire is fastened to the second strut and spaced from the second axle at a second distance. The hitter is fastened to the second axle. The holding rack securely clamps the cajon.

By means of the structure set forth above, the first and second struts can provide a lever function to increase the moving displacement of the drawing wire and enhance the instantaneous torsional force, thus the static friction force between the drawing wire and wire tube can be eliminated. Hence when the foot pedal is treaded to drive the hitter to hit the cajon, a smoother movement can be accomplished to meet use requirements.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
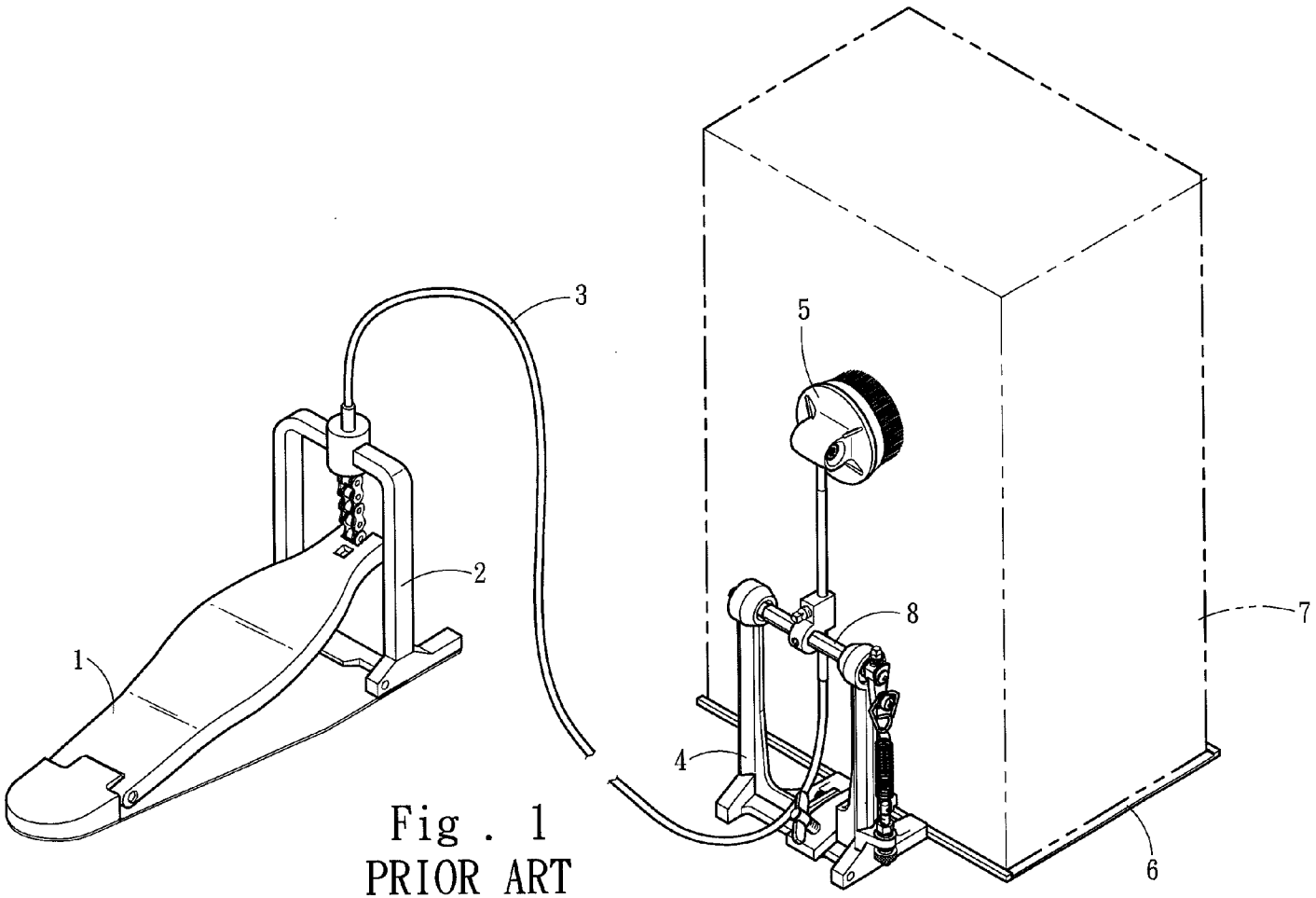
Fig. 1 PRIOR ART
FIG. 1 is a perspective view of the structure of a conventional technique.
Figure 2:
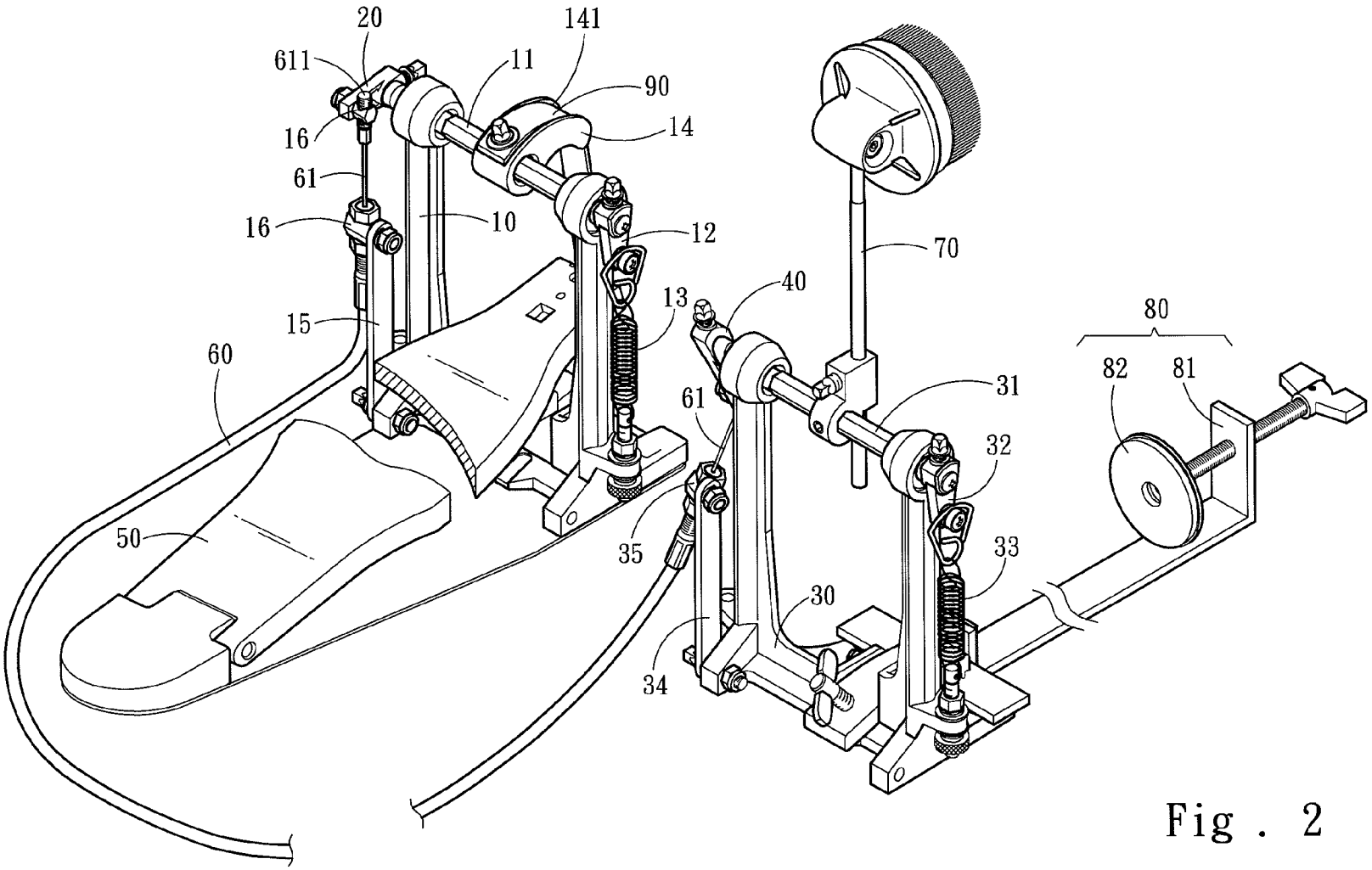
FIG. 2 is a perspective view of the structure of the invention.
Figure 3A:
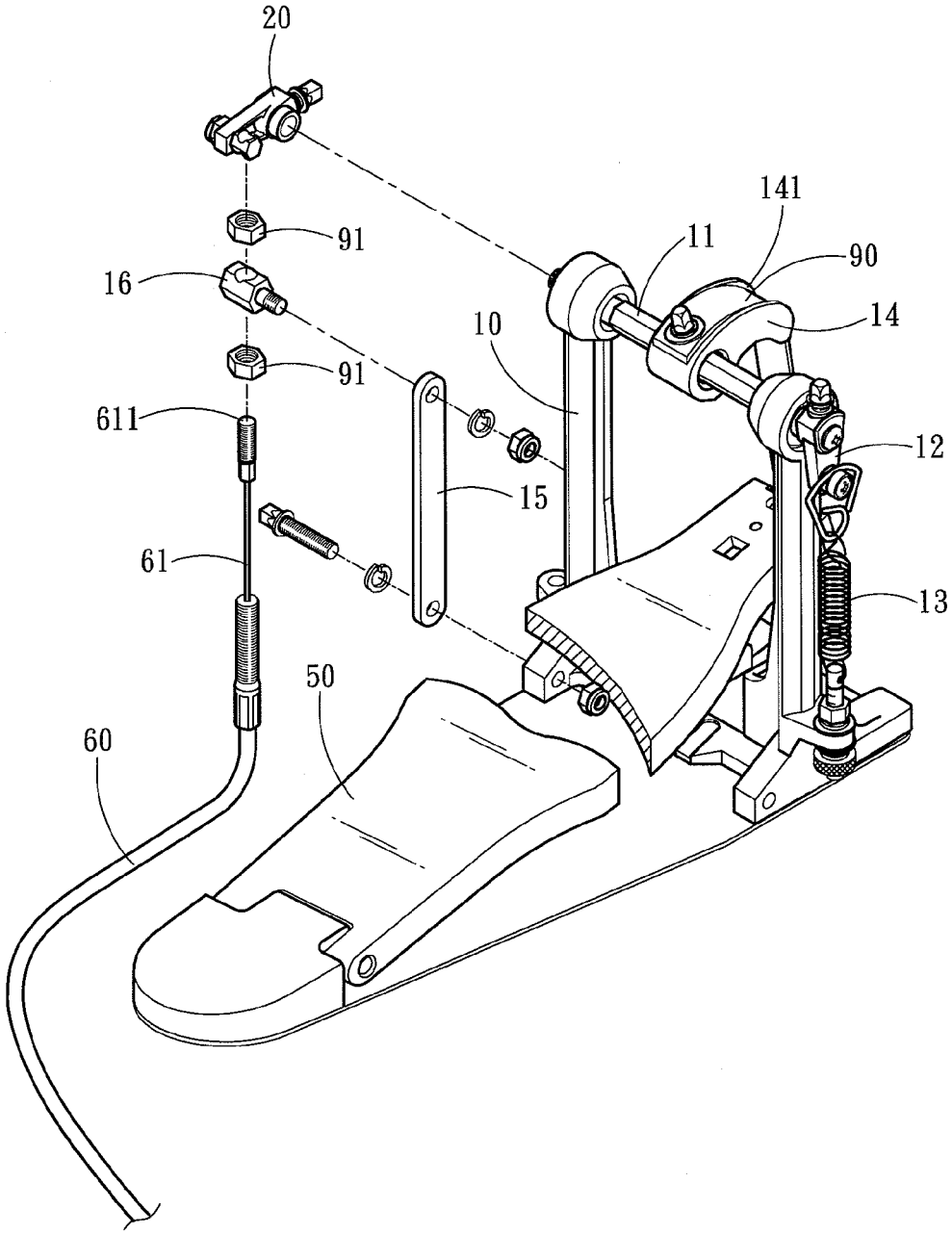
FIG. 3A is a fragmentary exploded view of the invention.
Figure 3B:
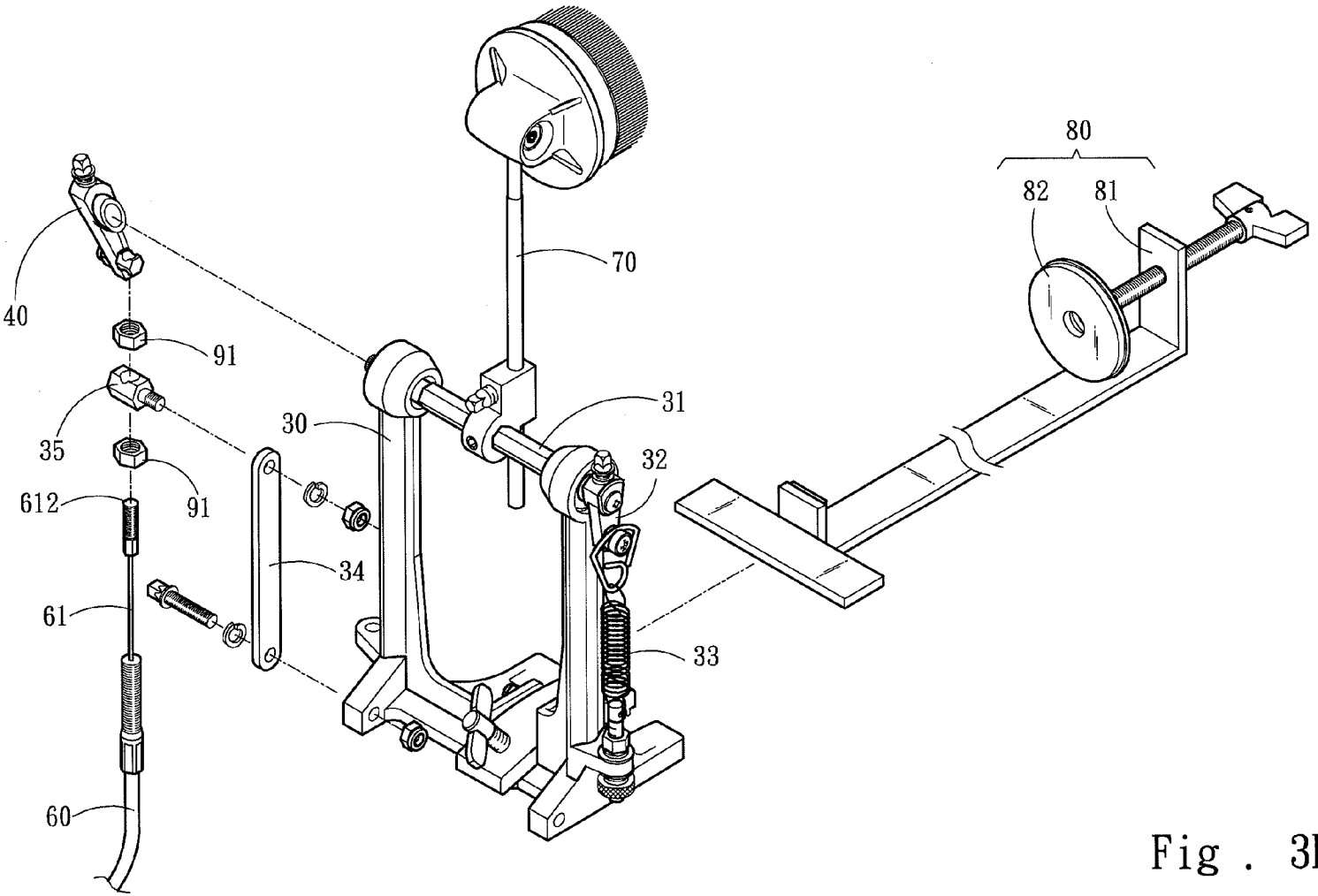
FIG. 3B is another fragmentary exploded view of the invention.
Figure 4:
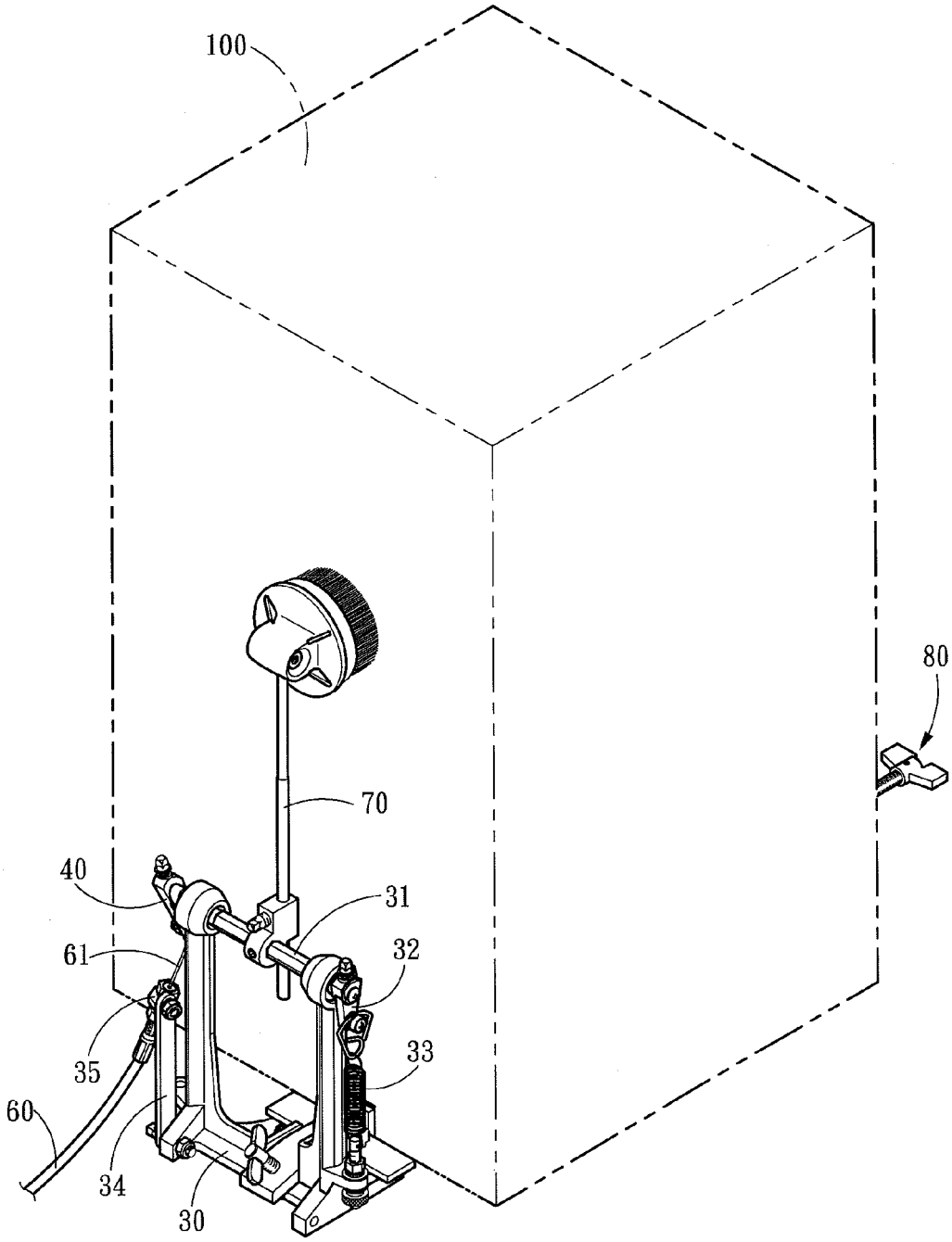
FIG. 4 is a schematic view of the invention in a use condition.

Please refer to FIGS. 2, 3A, 3B and 4, the present invention aims to provide a cajon hitting assembly to hit a cajon 100. It comprises a first upright post 10, a first strut 20, a second upright post 30, a second strut 40, a foot pedal 50, a wire tube 60, a hitter 70 and a holding rack 80. The first upright post 10 has a turnable first axle 11 located thereon. The first strut 20 has one end fastened to the first axle 11 which has a first fastening bar 12 extended downwards. The first upright post 10 and first fastening bar 12 are bridged by a first elastic element 13 which provides an elastic force for the turning of the first axle 11.

The second upright post 30 has a turnable second axle 31 located thereon. The second strut 40 has one end fastened to the second axle 31 which has a second fastening bar 32 extended downwards. The second upright post 30 and second fastening bar 32 are bridged by a second elastic element 33.

The foot pedal 50 drives the first axle 11 to turn. The first axle 11 is coupled by a drive bar 14 transversely. The drive bar 14 is coupled with the foot pedal 50 via a belt 90 which can draw and is flexible to drive the first axle 11 to turn. The drive bar 14 has a groove 141 to hold the belt 90 from loosening.

The wire tube 60 is threaded by a drawing wire 61 which has a start end 611 and a distal end 612. The wire tube 60 has two ends fastened respectively to the first upright post 10 and second upright post 30. The first upright post 10 has a first support bar 15 to hold the wire tube 60. The first support bar 15 is further fastened by a first holding member 16 via screwing. The wire tube 60 runs through the first holding member 16 and is fastened by two nuts 91, thereby the direction of the wire tube 60 can be confined to reduce the static friction force between the drawing wire 61 and wire tube 60. Similarly, the second upright post 30 has a second support bar 34 to hold the wire tube 60, and also is fastened by a second holding member 35. The wire tube 60 runs through the second holding member 35 and is fastened by another two nuts 91.

Figure 5A:
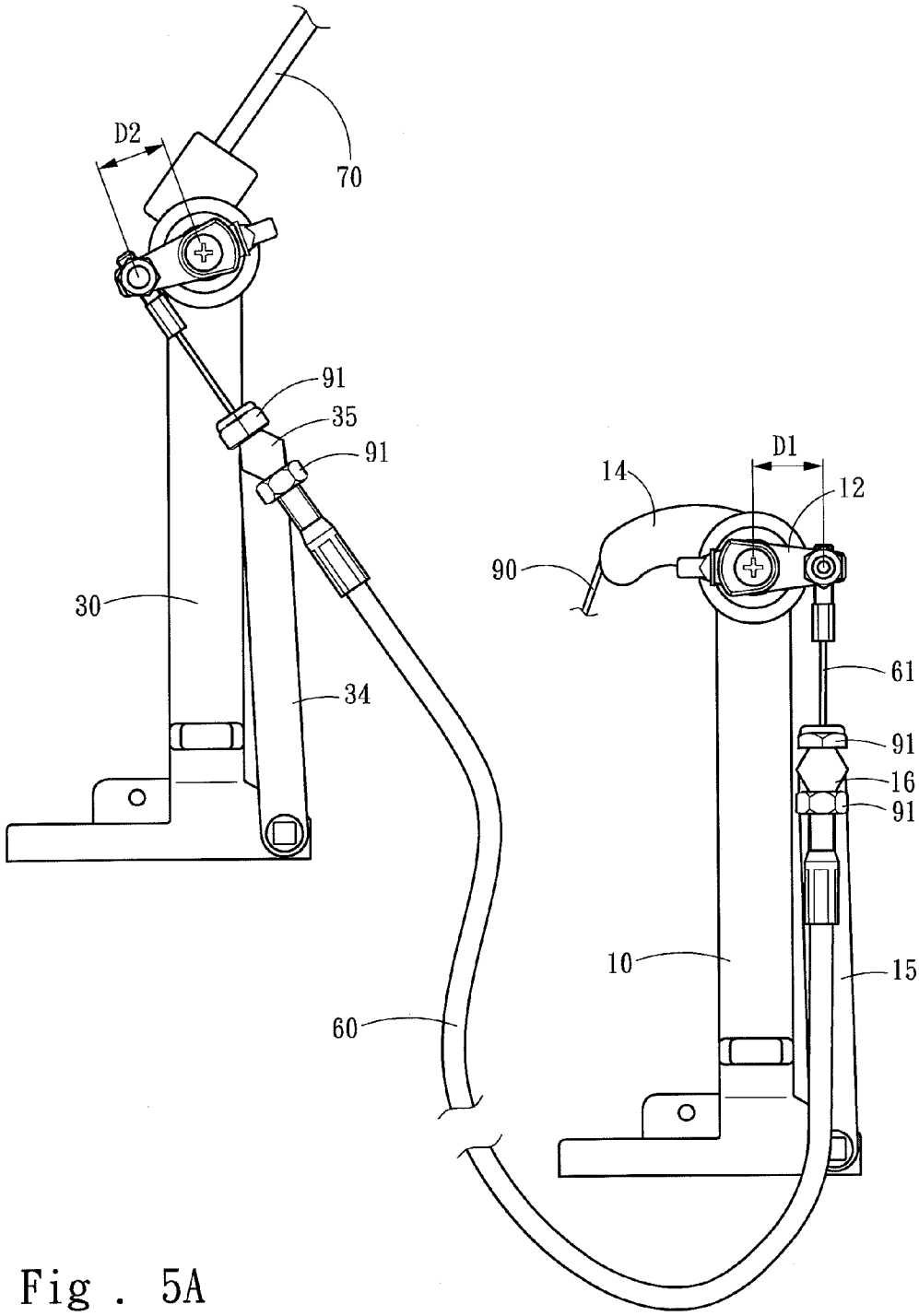
FIG. 5A is a schematic view of the drawing wire of the invention in a use condition.

The start end 611 of the drawing wire 61 is fastened to the first strut 20 and spaced from the first axle 11 at a first distance D1 (referring to FIG. 5A). The distal end 612 of the drawing wire 61 is fastened to the second strut 40 and spaced from the second axle 31 at a second distance D2 (referring to FIG. 5B). Through the first and second distances D1 and D2 and a lever principle, the moving displacement of the drawing wire 61 increases and the instantaneous torsional force also enhances, thereby the static friction force between the drawing wire 61 and wire tube 60 can be eliminated.

The hitter 70 is fastened to the second axle 31. The holding rack 80 securely clamps the cajon 100. The holding rack 80 has an L-shaped plate 81 fastened by an adjustment press disc 82 via screwing. Hence the invention is adaptable to the cajon 100 at varying sizes by adjusting the adjustment press disc 82.

Figure 5B:
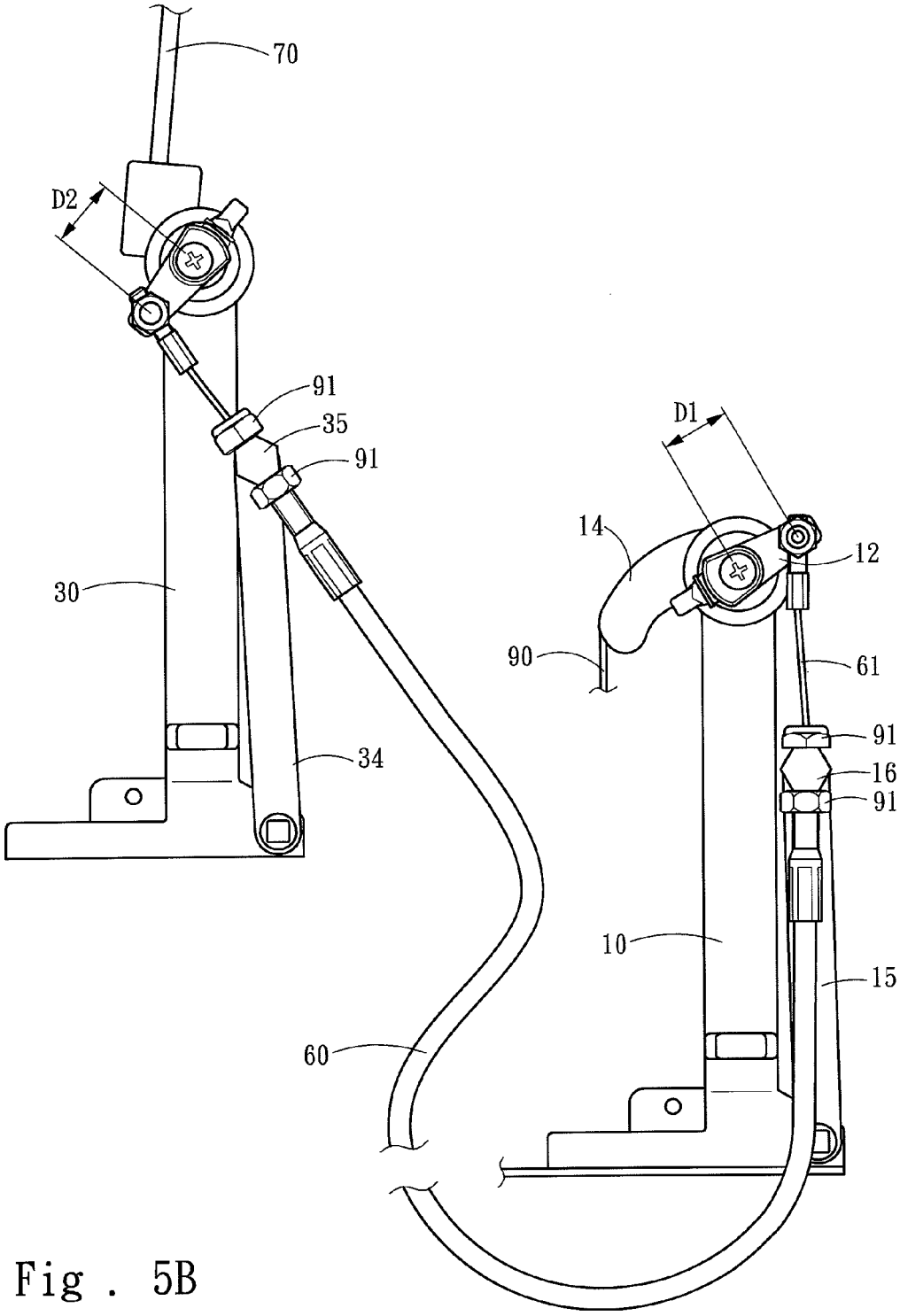
FIG. 5B is a schematic view of the drawing wire of the invention in another use condition.

Also referring to FIGS. 5A and 5B, when in use, a user treads on the foot pedal 50 to drive the first axle 11 to turn, and the first axle 11 then drives the drawing wire 61 to move and the second axle 31 to turn, thereby the hitter 70 is also driven to turn. Through the first and second distances D1 and D2, a lever action takes place on the first and second struts 20 and 40, hence not only the moving displacement of the drawing wire 61 increases, but also the instantaneous torsional force enhances, thereby the static friction force between the drawing wire 61 and wire tube 60 can be eliminated. As a result, smoothness of treading on the foot pedal 50 to drive the hitter 70 to hit the cajon 100 can be improved to meet use requirements.

What is claimed is:

1. A cajon hitting assembly to hit a cajon, comprising:

a first upright post including a turnable first axle located thereon;

a first strut including one end fastened to the first axle;

a second upright post including a turnable second axle located thereon;

a second strut including one end fastened to the second axle;

a foot pedal to drive the first axle to turn;

a wire tube which is threaded by a drawing wire with a start end and a distal end, and includes two ends fastened respectively to the first upright post and the second upright post; the start end of the drawing wire being fastened to the first strut and spaced from the first axle at a first distance, the distal end of the drawing wire being fastened to the second strut and spaced from the second axle at a second distance;

a hitter fastened to the second axle; and a holding rack securely clamping the cajon.

2. The cajon hitting assembly of claim 1, wherein the first axle includes a first fastening bar extended downwards, the first upright post and the first fastening bar being bridged by a first elastic element.

3. The cajon hitting assembly of claim 1, wherein the second axle includes a second fastening bar extended downwards, the second upright post and the second fastening bar being bridged by a second elastic element.

4. The cajon hitting assembly of claim 1, wherein the first axle is coupled by a drive bar transversely, the drive bar being coupled with the foot pedal through a belt.

5. The cajon hitting assembly of claim 4, wherein the drive bar includes a groove to hold the belt.

6. The cajon hitting assembly of claim 1, wherein the first upright post includes a first support bar to hold the wire tube.

7. The cajon hitting assembly of claim 6, wherein the first support bar is fastened by a first holding member via screwing, the wire tube running through the first holding member and being fastened by two nuts.

8. The cajon hitting assembly of claim 1, wherein the second upright post includes a second support bar to hold the wire tube.

9. The cajon hitting assembly of claim 8, wherein the second support bar is fastened by a second holding member via screwing, the wire tube running through the second holding member and being fastened by another two nuts.

10. The cajon hitting assembly of claim 1, wherein the holding rack includes an L-shaped plate fastened by an adjustment press disc via screwing.

* * * * *